United States Patent [19]

Mougin

[11] 4,177,748

[45] Dec. 11, 1979

[54] DEVICE FOR ATTACHING PROPULSION UNITS TO A TABULAR ICEBERG

[75] Inventor: Georges L. Mougin, Paris, France

[73] Assignee: ITI Limited, Paris, France

[21] Appl. No.: 884,405

[22] Filed: Mar. 8, 1978

[30] Foreign Application Priority Data

Mar. 8, 1977 [FR] France ..... 77 06704

[51] Int. Cl.[2] ..... B63H 23/32

[52] U.S. Cl. ..... 115/76; 115/76; 114/270; 405/217

[58] Field of Search ..... 114/270; 115/72, 76; 405/61, 217

[56] References Cited

U.S. PATENT DOCUMENTS 3,931,715 1/1976 Fitch et al. ..... 405/217

OTHER PUBLICATIONS

Cooper, Larry M. "Iceberg Farming: A New Supply of Fresh Water?" Ocean Industry, Mar. 1973, pp. 28-29.

*Primary Examiner*—Jesus D. Sotelo

*Attorney, Agent, or Firm*—George E. Kersey

[57] ABSTRACT

A flat flotation unit incorporates buoyancy chambers and has a lower portion adapted to be attached to a propulsion unit and an upper portion adapted to grip into the substantially horizontal lower surface of a tabular iceberg. The grip is provided by upstanding support members which are embedded in the iceberg during operation. The support members include heaters and are in the form of hollow right prisms with walls which are grooved to facilitate the escape of iceberg melt water during embedding and which have openings in the vicinity of their connection to the flotation unit to enable seawater to escape from their hollow interiors during embedding.

10 Claims, 3 Drawing Figures

DEVICE FOR ATTACHING PROPULSION UNITS TO A TABULAR ICEBERG

The present invention relates to the attachment of propulsion units to the substantially horizontal lower surface of tabular icebergs. These originate exclusively in the Antarctic, where the ice does not advance in the form of tongues, but forms a plateau with a well-defined frontier where it meets the ocean. The Antarctic continent is not encircled by mountains but is bordered by a rim of ice, part of which is supported on the continental shelf and the rest of which floats upon the surface of the ocean. Under the pressure of the ice inland, this mass of ice is gradually pushed towards the sea, and from time to time tabular icebergs become detached from the ice plateau. Although these can have areas of several kilometers, they can be towed to the coastal waters of the arid regions of the earth. Towing a tabular iceberg from the Antarctic to the northern hemisphere at a speed of 0.5 meters per second takes several months, however, and is far from straight-forward, in particular because of the number of tugs needed and the limited periods of autonomy available from the tugs (generally about one month). In such circumstances there is an interest in fitting electric propulsion units beneath the iceberg, and in supplying them with electrical power generated by an installation on the iceberg itself.

The height of the submerged portion of a rectangular tabular iceberg is 6 to 8 times of the height of the portion above sea level, and the total thickness of the iceberg may be some 250 to 300 meters.

The present invention is intended to provide a device for attaching underwater propulsion units with horizontal or vertical axes to the substantially horizontal lower surface of an iceberg. In the first case, the screw is housed within a shroud, and the in the second the propulsion units are of the "Voith-Schneider" type. The invention also includes the method of installing said device and the method of recovering it.

In accordance with the invention, the attachment device, to the lower end of which may be attached a propulsion unit, is in the form of a flat flotation unit incorporating a number of chambers or "ballasts", and to the upper portion of which are attached a number of support members destined to be embedded in the ice of the iceberg and to transmit the thrust. The walls of the support members are grooved to permit the passage of melted ice, and the support members may be heated by means of electrical resistances embedded in the thickness of their walls. The heat generated may be distributed by circulation of oil. Each attachment device includes a number of support members, generally at least three in number, in order to produce good distribution of the force exerted by the propulsion unit over the surface of the iceberg.

The device is installed by exerting an upward force parallel to the axes of the support members, which are heated in order to partially melt the ice of the iceberg, so that they become partially embedded in the iceberg. This upward pressure is obtained by virtue of the Archimedean upthrust generated by expelling seawater from the flotation unit chambers using compressed air or a pyrotechnically generated gas. The device is maintained horizontal by independently controlling the temperatures of the support members, so that they become embedded in the ice of the iceberg more or less rapidly.

A number of propulsion units may be installed beneath an iceberg in a single operation. The propulsion units are attached to the lower surfaces of attachment devices in accordance with the invention and connected to one another and to flotation units for compensating for the negative buoyancy of the propulsion units by means of cables. The flotation units for compensating the negative buoyancy of the propulsion units may be towed by tugs and are used to draw the propulsion units and attachment devices beneath the iceberg, the propulsion units and attachment devices being installed beneath the iceberg by simultaneously heating the support members to melt the ice and applying an Archimedean upthrust.

The propulsion units are recovered by a method which is the reverse of the installation method and which consists in expelling the air contained in the chambers of the flotation units whilst heating the support members. The propulsion units then descend towards the sea bed, and it is possible to remove them from beneath the iceberg by means of the tugs.

The invention will now be described in more detail, by way of example only and with reference to the accompanying diagrammatic drawings, in which.

Figure 1:
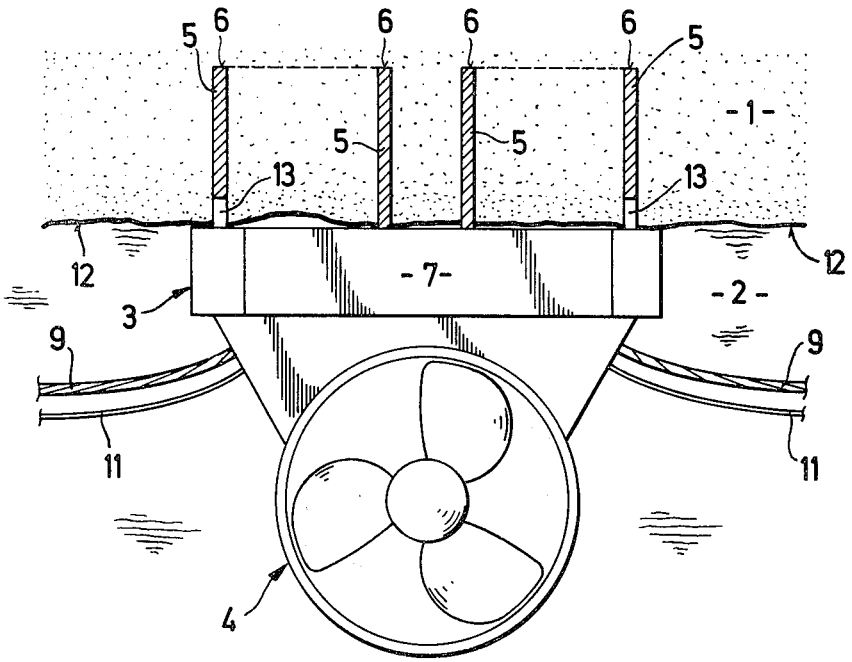
FIG. 1 is a vertical cross-section through an attachment device in accordance with the invention embedded in an iceberg.

FIG. 1 shows the lower portion of an iceberg (1) floating in the sea (2). A device (3) for attaching a propulsion unit (4) to the iceberg has its support members (5) embedded in the ice of the iceberg (1). The support members (5) are vertical tubes with a diameter of a few meters and a thickness of a few decimeters. Within the thickness of the tube walls are located electrical resistances for heating the walls and the upper edges (6), which can be heated to a higher temperature than the remainder of the walls. The tube walls are grooved to enable the water resulting from the melting of the ice of the iceberg (1) to run down into the sea (2). The support members (5) are attached to a flat flotation unit (7) incorporating a number of chambers. The propulsion unit (4) is attached to the side of the flotation unit (7) opposite to the support members (5). As a result the centre of thrust of the assembly comprising the propulsion unit and the attachment device is well above its centre of gravity, which provides good stability.

Figure 2:
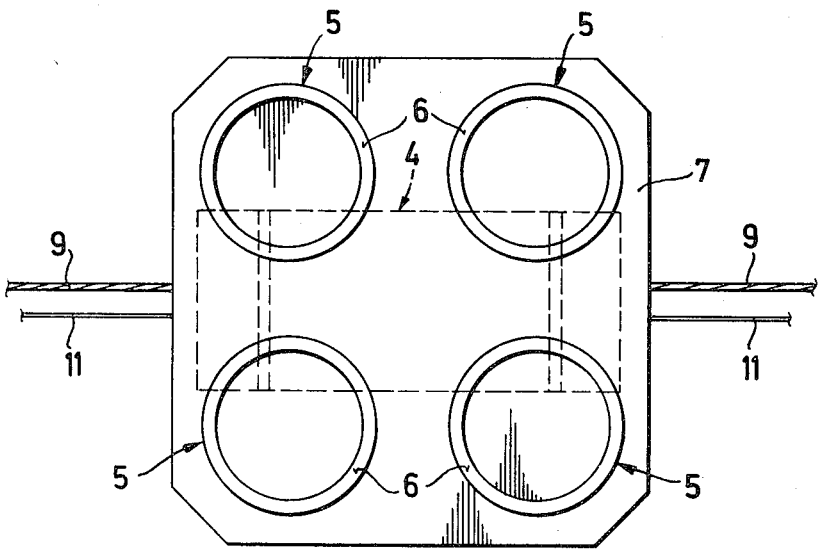
FIG. 2 is a view of the device shown in FIG. 1, as seen from above.

As can be seen from FIG. 2, the device incorporates four support members (5) so as to ensure good distribution over the ice of the horizontal force resulting from the thrust exerted by the propulsion unit (6), which remains lower than the creep load. The device (3) is installed by exerting an upward force parallel to the axes of the support members (5), the walls and especially the upper edges (6) of which are heated to partially melt the ice of the iceberg (1). This results in them being embedded in the iceberg (1), the melted ice running down towards the sea (2) via the grooves on the surface of the support members. This vertical pressure is derived from the Archimedean upthrust created by expelling water from the chambers of the flat flotation unit (7) by means of compressed air or a pyrotechnically generated gas. The device is maintained horizontal by independently controlling the temperatures of the support members (5), which become embedded in the ice of the iceberg (1) more or less rapidly.

Figure 3:
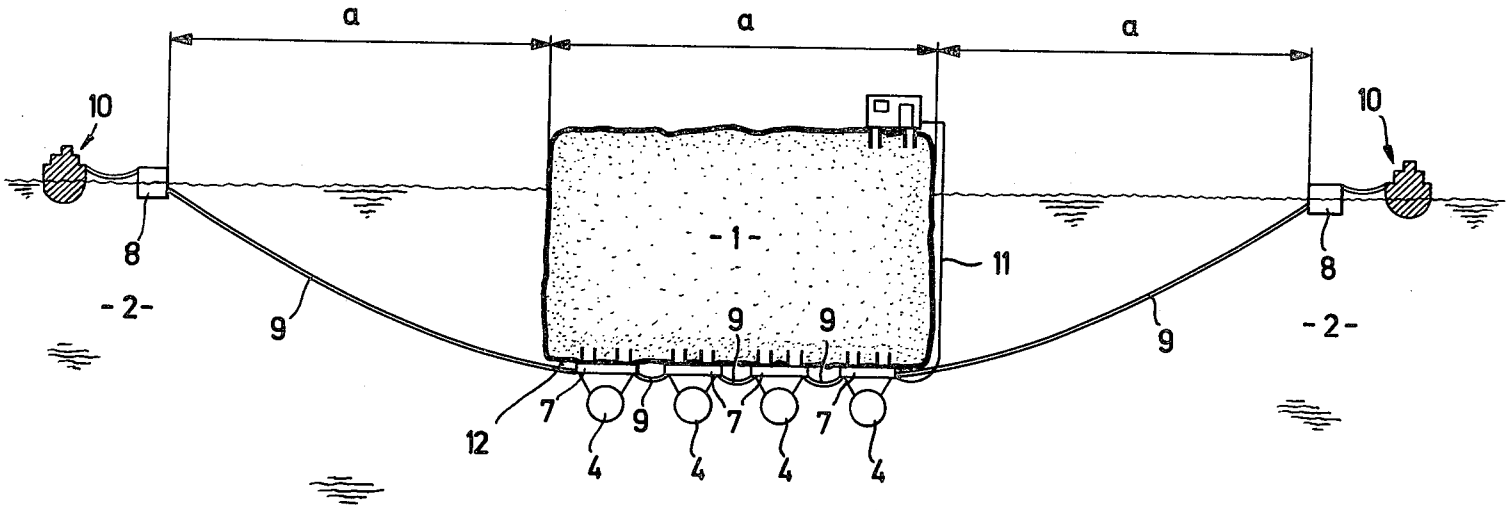
FIG. 3 illustrates the method for installing propulsion units fitted to attachment devices in accordance with the invention on the substantially horizontal lower surface of an iceberg.

FIG. 3 illustrates the installation of a string of propulsion units (4) attached to the lower surfaces of attachment devices (3) and connected to one another and to flotation units (8) for compensating for the negative buoyancy of the propulsion units (4) by means of cables (9). These compensatory flotation units (8) are towed by tugs (10). After being unloaded from an auxiliary vessel, the assemblies comprising the propulsion units and attachment devices, the number of which depends on the width of the iceberg, are connected together by means of traction cables (9) connected to electrical power supply cables and command and control cables (11). The compensatory flotation units (8) are separated by a distance which is approximately three times the width of the iceberg (1). The flotation units (7) are simultaneously and progressively filled with water, so that their buoyancy becomes slightly negative. A small volume of air is maintained in the upper portion of each flotation unit (7), so as to maintain the vertical stability of the assembly comprising the flotation unit and the propulsion unit. The string of propulsion units (4) and associated flotation units (3) is submerged to a depth greater than the draught of the iceberg (1) and then drawn beneath the iceberg to positions located immediately beneath their respective attachment positions. Positive buoyancy is restored to the flotation units (7) by means of a pyrotechnically generated gas or by filling them with compressed air from pressurised bottles or supplied from compressors located on the surface, either on the iceberg (1) or on the tugs (10). The Archimedean upthrust applies the attachment devices (3) to the substantially horizontal lower surface (12) of the iceberg (1). The support members (5) are then heated and slowly become embedded in the ice of the iceberg (1) as the ice is melted. The seawater contained within the tubular support members (5) is expelled as the device (3) penetrates into the ice of the iceberg (1). To this end, openings (13) are provided at the base of each support member (5).

The assemblies comprising the propulsion units and attachment devices are recovered by a method which is the reverse of the installation method, and basically consists in producing negative buoyancy, the walls of the support members (5) being heated so as to facilitate the descent of the string of propulsion units beneath the iceberg (1).

The claims defining the invention are as follows:

1. A device for attaching underwater propulsion units to the substantially horizontal lower surface of a tabular iceberg, the device comprising a flat flotation unit incorporating buoyancy chambers, the lower portion of the flotation unit being adapted to be attached to a propulsion unit, and the upper portion of the flotation unit having a plurality of upstanding support members for embedding in the lower surface of the iceberg, the support members including heating means and being in the form of hollow right prisms with walls which are grooved to facilitate the escape of iceberg melt water during embedding and which have openings in the vicinity of their connection to the flotation unit to enable seawater to escape from the hollow interior of the support members during embedding.

2. A device according to claim 1 wherein the heating means are in the form of electrical resistances embedded in the thickness of the walls of the support members.

3. A device according to claim 1 wherein the heating means are arranged to heat the upper edges of the support member walls to a higher temperature than the remainder of the walls.

4. A device according to claim 2 wherein the heating means of each support member is independently controllable in order to facilitate maintaining the flat flotation unit substantially horizontal during embedding.

5. A device according to any claim 1 including means for expelling sea water from the buoyancy chambers to provide Archimedean upthrust during embedding.

6. A device according to claim 5 wherein said means for expelling sea water comprise a pyrotechnic gas generator.

7. The method of installing a device for propelling an iceberg, comprising the steps of:

(a) filling a flotation unit secured to a propulsion device with water and submerging the propulsion device to a depth at least equal to the draft of the iceberg;

(b) positioning said propulsion device beneath the iceberg;

(c) expelling water from said flotation unit to supply an Archimedean upthrust to said propulsion device at the lower surface of said iceberg.

8. The method of claim 7 further including the step of heating support members on said flotation unit to permit penetration into the ice of the lower surface of said iceberg during the application of said Archimedean upthrust.

9. The method of installing a plurality of devices for propelling an iceberg, comprising the steps of:

(a) joining the devices together by traction, power and control cables;

(b) filling flotation units of said devices with water and submerging said devices to a depth at least equal to the draft of said iceberg;

(c) distributing said devices beneath the iceberg;

(d) expelling water from said flotation units to apply an Archimedean upthrust to said devices to cause them to be embedded in the ice of said iceberg.

10. The method of recovering a propulsion device attached to a lower surface of an iceberg comprising the steps of (a) heating a support member attaching the propulsion device to said iceberg to partially melt the ice thereof and release the support member therefrom; and (b) filling a flotation unit of the device with water to exercise an Archimedean downthrust on said support member and carry said device away from said iceberg.

* * * * *